US012291870B2

(12) United States Patent
Leitch

(10) Patent No.: US 12,291,870 B2
(45) **Date of Patent: *May 6, 2025**

(54) ROOFING SHINGLES WITH SEALANT PRESSURE RELIEF CHANNEL

(71) Applicant: BMIC LLC, Dallas, TX (US)

(72) Inventor: Olan T. Leitch, Mt. Juliet, TN (US)

(73) Assignee: BMIC LLC, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/073,887

(22) Filed: Dec. 2, 2022

(65) Prior Publication Data

US 2023/0203813 A1 Jun. 29, 2023

Related U.S. Application Data

(63) Continuation of application No. 17/548,621, filed on Dec. 13, 2021, now Pat. No. 11,519,176.

(60) Provisional application No. 63/125,158, filed on Dec. 14, 2020.

(51) Int. Cl.
*E04D 1/26* (2006.01)
*E04D 1/34* (2006.01)

(52) U.S. Cl.
CPC ..... *E04D 1/26* (2013.01); *E04D 1/34* (2013.01); *E04D 2001/3435* (2013.01)

(58) Field of Classification Search
CPC ..... E04D 1/26; E04D 1/34; E04D 2001/3435; E04D 1/2963
See application file for complete search history.

(56) References Cited

U.S. PATENT DOCUMENTS

| | | | |
|---|---|---|---|
| 4,189,886 | A | 2/1980 | Frohlich et al. |
| 4,439,955 | A | 4/1984 | Freiborg |
| 4,835,929 | A | 6/1989 | Bondoc et al. |
| 5,094,042 | A | 3/1992 | Freborg |
| 5,122,095 | A | 6/1992 | Wolfert |
| 5,247,771 | A | 9/1993 | Poplin |
| 5,271,201 | A | 12/1993 | Noone et al. |
| 5,288,269 | A | 2/1994 | Hansen |
| 5,377,459 | A | 1/1995 | Freiborg |
| 5,419,941 | A | 5/1995 | Noone et al. |
| 5,471,801 | A | 12/1995 | Kupczyk et al. |
| 5,575,876 | A | 11/1996 | Noone et al. |
| 5,921,863 | A | 7/1999 | Sells |
| D422,095 | S | 3/2000 | Thagard, III et al. |
| 6,083,592 | A | 7/2000 | Chich |
| 6,125,602 | A | 10/2000 | Freiborg et al. |
| 6,298,613 | B1 | 10/2001 | Coulton et al. |

(Continued)

OTHER PUBLICATIONS

Definition of ALONG https://www.merriam-webster.com/dictionary/along. (Year: 2024).*

*Primary Examiner* — Adriana Figueroa
(74) *Attorney, Agent, or Firm* — GREENBERG TRAURIG, LLP

(57) ABSTRACT

A roofing shingle has an upper surface, a lower surface, and a sealant material applied along the lower surface. A pressure relief channel is formed along the lower surface of the roofing shingle, with a release strip applied over the pressure relief channel. When the roofing shingle is paired with another roofing shingle in a stack, the sealant material of the roofing shingle is arranged in registration with the release strip and pressure relief channel of the other roofing shingle.

18 Claims, 5 Drawing Sheets

(56) References Cited

U.S. PATENT DOCUMENTS

| | | | |
|---|---|---|---|
| 6,308,472 | B1 | 10/2001 | Coulton et al. |
| 6,351,913 | B1 | 3/2002 | Freiborg et al. |
| 6,361,434 | B1 | 3/2002 | Brandon |
| 6,449,910 | B1 | 9/2002 | Budd |
| 6,471,812 | B1 | 10/2002 | Thompson et al. |
| 6,813,866 | B2 | 11/2004 | Naipawer, III |
| 6,895,724 | B2 | 5/2005 | Naipawer, III |
| 6,981,916 | B2 | 1/2006 | Coulton |
| 7,594,363 | B2 | 9/2009 | Polumbus et al. |
| 7,604,536 | B2 | 10/2009 | Coulton et al. |
| 7,921,606 | B2 | 4/2011 | Quaranta et al. |
| 8,266,861 | B2 | 9/2012 | Koch et al. |
| 8,281,520 | B2 | 10/2012 | Quaranta et al. |
| 8,371,085 | B2 | 2/2013 | Koch |
| 8,613,165 | B2 | 12/2013 | Bleil et al. |
| 8,820,020 | B2 | 9/2014 | Koch et al. |
| 8,820,021 | B2 | 9/2014 | Kalkanoglu |
| 8,839,576 | B1 | 9/2014 | Newcomb |
| 9,097,020 | B2 | 8/2015 | Grubka et al. |
| 9,200,453 | B2 | 12/2015 | Kerwood-Winslow et al. |
| 9,290,938 | B2 | 3/2016 | Kelly |
| 9,303,410 | B2 | 4/2016 | Steffes et al. |
| 9,428,916 | B2 | 8/2016 | Railkar et al. |
| 9,560,787 | B2 | 5/2017 | Montojo et al. |
| 10,196,823 | B2 | 2/2019 | Rotter |
| 10,787,814 | B2 | 9/2020 | Duque et al. |
| 11,203,871 | B2 | 12/2021 | Duque et al. |
| 11,519,176 | B2 | 12/2022 | Leitch |
| 2002/0032000 | A1 | 3/2002 | Lawless, III et al. |
| 2004/0224114 | A1 | 11/2004 | Patel |
| 2005/0126088 | A1 | 6/2005 | Rotter |
| 2005/0193673 | A1 | 9/2005 | Rodrigues et al. |
| 2005/0252141 | A1 | 11/2005 | Kerkar et al. |
| 2006/0096189 | A1 | 5/2006 | Pavlansky et al. |
| 2006/0179767 | A1 | 8/2006 | Miller et al. |
| 2008/0220714 | A1 | 9/2008 | Caruso et al. |
| 2010/0196647 | A1 | 8/2010 | Bryson et al. |
| 2011/0072752 | A1 | 3/2011 | Aschenbeck et al. |
| 2011/0197534 | A1 | 8/2011 | Belt et al. |
| 2011/0283646 | A1 | 11/2011 | Vermilion et al. |
| 2013/0025225 | A1 | 1/2013 | Vermilion et al. |
| 2014/0179220 | A1 | 6/2014 | Railkar et al. |
| 2017/0321423 | A1 | 11/2017 | Aschenbeck et al. |
| 2019/0161970 | A1 | 5/2019 | Strickland |
| 2020/0248456 | A1 | 8/2020 | Click et al. |

* cited by examiner

ROOFING SHINGLES WITH SEALANT PRESSURE RELIEF CHANNEL

REFERENCE TO RELATED APPLICATIONS

The present patent application is a continuation of U.S. patent application Ser. No. 17/548,621, filed Dec. 13, 2021, which claims benefit of U.S. Provisional Patent Application No. 63/125,158, filed Dec. 14, 2020.

INCORPORATION BY REFERENCE

U.S. patent application Ser. No. 17/548,621, filed Dec. 13, 2021, and U.S. Provisional Patent Application No. 63/125,158, filed Dec. 14, 2020, are specifically incorporation by reference herein as if set forth in their entireties.

TECHNICAL FIELD

This disclosure relates generally to roofing shingles and stacks of roofing shingles, and in particular to roofing shingles configured to reduce and/or minimize compression of sealant materials applied thereto.

BACKGROUND

In some examples, roofing shingles can include a sealant applied (e.g., in a strip, in discrete segments, etc.) to a lower surface of the roofing shingle for securing a portion of the roofing shingle to a previously-applied roofing shingle and/or to a portion of a roof deck. However, the sealant can become compressed when the roofing shingles are arranged in a stack for packaging, storage, shipping, etc. due to the weight of the shingles in the stack. A need therefore exists for roofing shingles and systems and methods of forming roofing shingles configured to reduce the compression of a sealant applied to the roofing shingles when the roofing shingles are packaged in stacks; and other related and unrelated problems in the art.

SUMMARY

Briefly described, roofing shingles are formed with a pressure relief channel extending along a surface thereof. A sealant material can be applied to form a strip of sealant material or other pattern along a lower surface of the roofing shingles for bonding each roofing shingle to a previously-installed roofing shingle when installing the roofing shingles on a roof deck or substrate. During formation of the roofing shingles, a release strip can be applied over the pressure relief channel to help prevent the sealant material from bonding to an adjacent roofing shingle. When the roofing shingles are paired and arranged in stacks for packaging and storage or transport, the strip of sealant material can be aligned with the pressure relief channel so that the strip of sealant material is at least partially in registration with the pressure relief channel. The pressure relief channel can provide clearance for the sealant material of the strip of sealant material between stacked roofing shingles, to help reduce the pressure on the strip of sealant material during packaging and storage. This reduction in pressure can in turn help reduce caliper loss of the sealant material that can occur when the roofing shingles are stacked together.

The pressure relief channel thus can enhance the sealant performance by helping to maintain a sealant caliper, in embodiments, substantially cutting the caliper loss of the strip of sealant material. The reduction in caliper loss of the strip of sealant material can lead to less added sealant material needed to compensate for caliper loss, which further can lead to a reduction in manufacturing costs.

Various aspects of roofing shingles having a sealant pressure relief channel, stacks of roofing shingles, and methods of forming roofing shingles, are provided by the present disclosure.

In one non-limiting aspect, a roofing shingle is provided, comprising a substrate including an upper surface having a headlap portion configured to be overlapped by at least one additional roofing shingle arranged in a next higher course of roofing shingles on a roof, and a lower surface opposite the upper surface, the lower surface having a pressure relief channel defined therein and extending along at least a portion of the lower surface; a strip of sealant material applied to the lower surface of the substrate; and a release strip positioned: (i) along the lower surface of the substrate and (ii) over the pressure relief channel; wherein, when the roofing shingle is aligned with a second roofing shingle in a stack of roofing shingles, the pressure relief channel of the roofing shingle is aligned with a strip of sealant material applied to a lower surface of the second roofing shingle.

In embodiments of the roofing shingle, the substrate further comprises a coating layer on the lower surface, and wherein the pressure relief channel is in the coating layer.

In some embodiments of the roofing shingle, the pressure relief channel comprises a depression in the lower surface at a depth of 0.001 inch to 0.075 inch.

In embodiments of the roofing shingle, the pressure relief channel comprises a depth that is less than or substantially equal to a thickness of the sealant material of the strip of sealant material.

In some embodiments of the roofing shingle, the substrate further comprises a coating layer on the lower surface, the coating layer having a thickness, and wherein the pressure relief channel is in the coating layer at a sufficient depth to at least partially receive the strip of sealant material of the second shingle therein.

In embodiments, the pressure relief channel comprises a depression in the lower surface of the substrate opposite the headlap portion and wherein the depression is at a sufficient depth to at least partially receive the strip of sealant material of the second roofing shingle aligned therewith.

According to another aspect of the disclosure, a stack of roofing shingles is provided, comprising a plurality of roofing shingles, each of the roofing shingles comprising an upper surface having a headlap portion configured to be overlapped by at least one additional roofing shingle arranged in a next higher course of roofing shingles on a roof, a lower surface having a pressure relief channel defined therein, a strip of sealant material disposed along at least a portion of the lower surface, and a release strip positioned over the pressure relief channel defined along the lower surface of each roofing shingle, wherein the roofing shingles are stacked such that the strip of sealant material of a first roofing shingle is aligned with the pressure relief channel of a second roofing shingle.

In embodiments, each roofing shingle of the plurality of roofing shingles further comprises a substrate with a coating layer applied to at least one surface thereof, the coating layer having a thickness and defining the lower surface the roofing shingle.

In embodiments, the pressure relief channel of each roofing shingle is in the coating layer and has a depth less than or substantially equal to the thickness of the coating layer and sufficient to at least partially receive at least a portion of the strip of sealant material of an adjacent roofing shingle in the stack of roofing shingles.

In some embodiments, the pressure relief channel comprises a depression formed in the lower surface at a depth of 0.001 inch to 0.075 inch.

In some embodiments, the strip of sealant material comprises a self-seal sealant material.

In embodiments, the strip of sealant material of the first roofing shingle is aligned with a pressure relief channel of the second roofing shingle such that the strip of sealant material of the first roofing shingle is at least partially received within the pressure relief channel of the second roofing shingle.

In embodiments, the pressure relief channel of each roofing shingle comprises a depth that is substantially equal to a thickness of the strip of sealant material.

In embodiments, the pressure relief channel of each shingle includes a substantially concave surface and has a width that is greater than a width of the strip of sealant material; and wherein the release strip extends along the substantially concave surface of the pressure relief channel, defining a liner between the strip of sealant material and the substantially concave surface of the pressure relief channel.

In another aspect, the method is provided, comprising: (a) moving a substrate of roofing shingle material along a path; (b) applying a coating layer to at least one surface of the substrate of roofing shingle material; (c) forming a pressure relief channel in the coating layer, the pressure relief channel extending along the coating layer in a machine direction; (d) applying a self-seal sealant material to at least one surface of the substrate of roofing shingle material to form a strip of sealant material along the at least one surface of the substrate of roofing shingle material; and (e) applying a release strip over the pressure relief channel.

In embodiments of the method, forming the pressure relief channel in the coating layer comprises removing a portion of the coating layer. In some embodiments, forming a pressure relief channel in the coating layer comprises forming a depression having a depth that is substantially equal to a thickness of the strip of sealant material.

In embodiments, the method further comprises cutting the substrate of roofing shingle material to form a plurality of roofing shingles, and stacking the roofing shingles, wherein the strip of sealant material of a first roofing shingle is aligned with a pressure relief channel of a second roofing shingle such that the strip of sealant material of the one roofing shingle is at least partially received within the pressure relief channel of the adjacent roofing shingle.

In embodiments of the method, forming the pressure relief channel in the coating layer comprises forming a depression within the coating layer at a depth less than or substantially equal to a thickness of the coating layer.

In embodiments of the method, forming the pressure relief channel in the coating layer comprises forming a depression in the coating layer; wherein the pressure relief channel of a first shingle has a depth sufficient to at least partially receive at least a portion of the strip of sealant material of a second roofing shingle, and the pressure relief channel of the first roofing shingle has a depth sufficient to at least partially receive at least a portion of the strip of sealant material of the first roofing shingle.

The foregoing and other aspects, features and components of roofing shingles with sealant pressure relief channels defined therein, and systems and methods of forming such roofing shingles and embodiments thereof, in accordance with the principles of the present disclosure, will be better understood upon review of the detailed description set forth below, taken in conjunction with the accompanying drawing figures, which are briefly described as follows.

Those skilled in the art will appreciate and understand that, according to common practice, the various features of the drawings discussed below are not necessarily drawn to scale, and that the dimensions of various features and elements of the drawings may be expanded and/or reduced to more clearly illustrate the embodiments of the present disclosure as described herein.

DETAILED DESCRIPTION

The embodiments of the present disclosure will now be described in more detail with reference to the attached drawing figures.

According the present disclosure, as illustrated in FIGS. 1A-6B, a plurality of roofing shingles are formed, each including a substrate or a web, such as a fibrous web, that can be saturated and/or coated with asphalt or other suitable materials, and covered on an upper side with protective material such as granules (e.g., ceramic and/or other suitable granules). In addition, one or more coatings can be applied to an underside of the web. For example, the roofing shingle can be a multi-layer architectural shingle such as a Timberline® HDZ shingle from GAF of Parsippany, NJ.

Figure 1A:
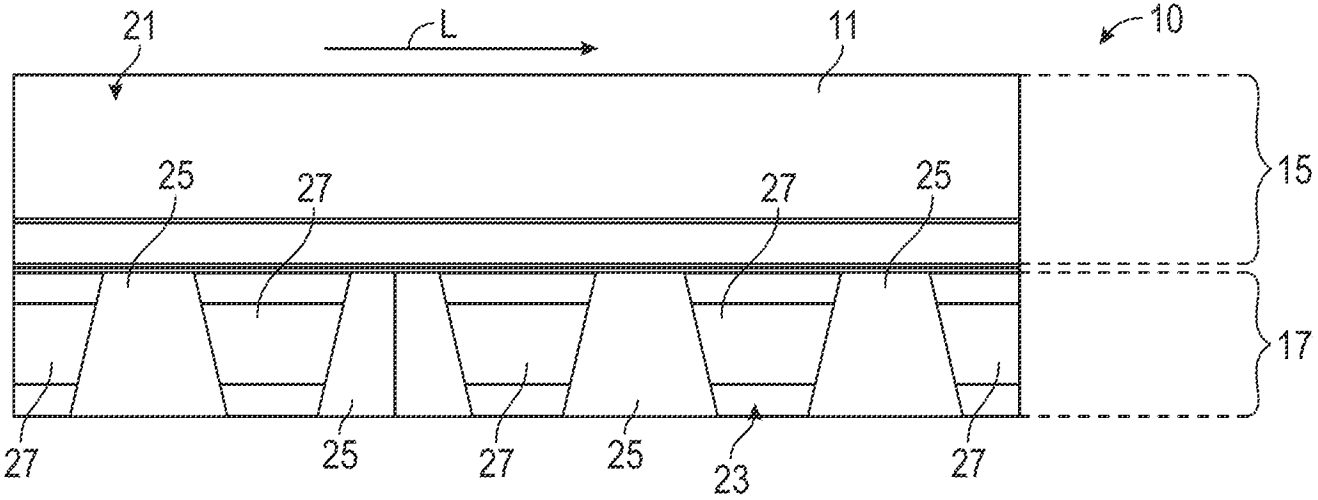
FIG. 1A is a schematic top plan view of a roofing shingle according to an exemplary embodiment of the disclosure.
Figure 1B:
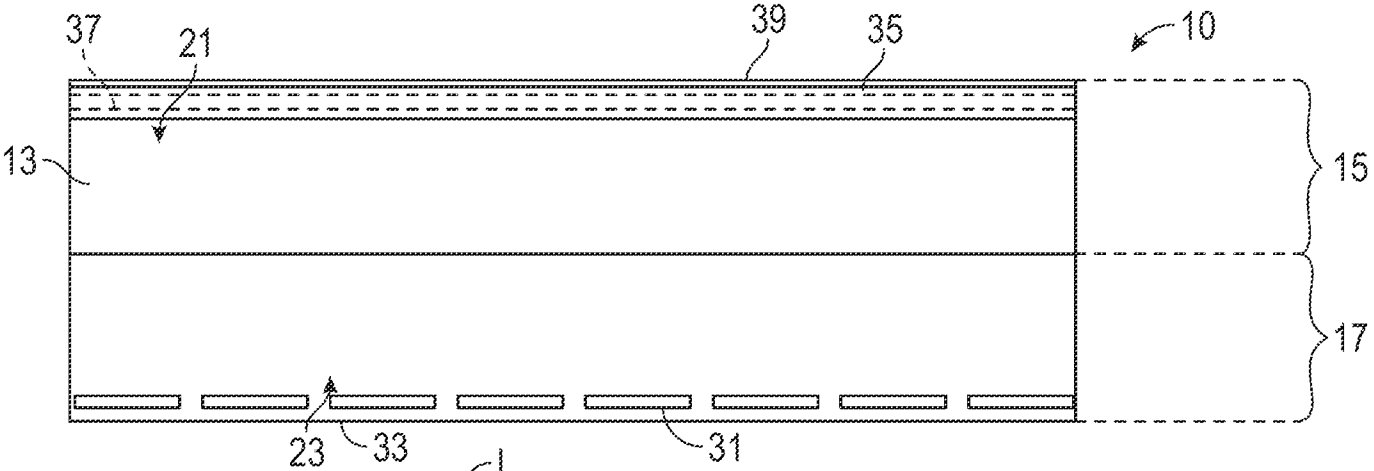
FIG. 1B is a schematic bottom plan view of the roofing shingle of FIG. 1A.

As schematically shown in FIGS. 1A and 1B, each roofing shingle 10 can include an upper, exterior side surface 11 (FIG. 1A) and a lower, bottom side surface 13 (FIG. 1B) that faces a roof deck and/or a portion of a previously-installed roofing shingle when the roofing shingle 10 is installed on a roof. In the illustrated embodiment, the roofing shingle 10 includes a headlap portion 15 and an exposure portion 17, with the headlap portion 15 adapted to be overlapped by a next higher course of roofing shingles when the roofing shingles 10 are installed on the roof deck. As indicated in FIG. 1A, different materials and/or different colors of materials (i.e., different color and/or different material granules) can be applied on the upper surface 11 of the roofing shingle for weatherproofing functions and/or for aesthetic purposes.

As shown in FIGS. 1A and 1B, the roofing shingle 10 can include a base formed from a web or substrate material, and can include one or more layers such as an anterior layer 21 and a posterior layer 23 that are adhered together. In the illustrated embodiment, the anterior layer 21 forms the exterior surface 11 of the roofing shingle 10, and can include tabs 25, which can be formed as "teeth," that are spaced apart from one another by openings 27 (FIG. 1A) so that a portion of the posterior layer 23 is visible from the upper surface 11 via the openings 27. The posterior layer forms the lower surface 13 (FIG. 1B) of the roofing shingle 10 and can include one or more additional layers, including or being formed from a coating material.

Figure 2A:
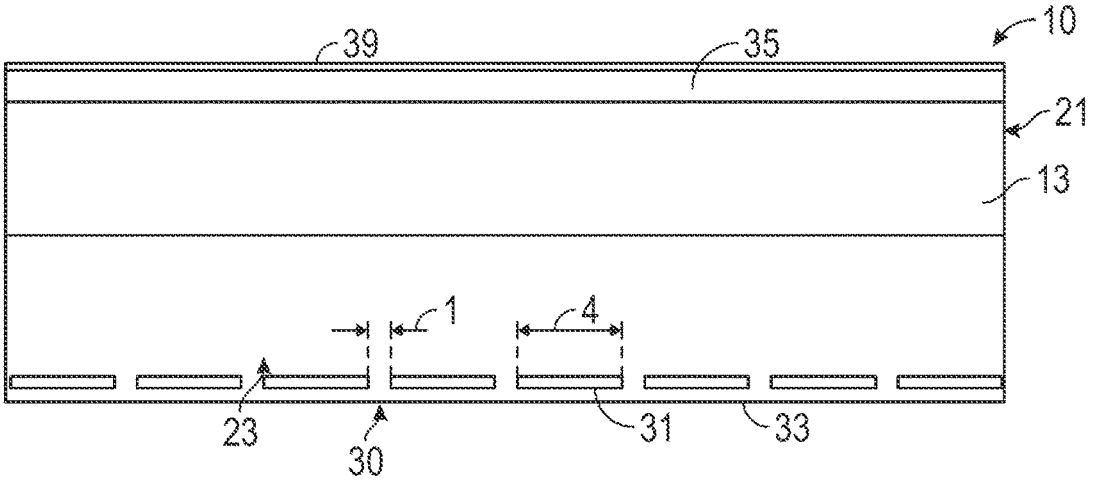
FIGS. 2A-2C are schematic views of the roofing shingle of FIGS. 1A and 1B.
Figure 2B:
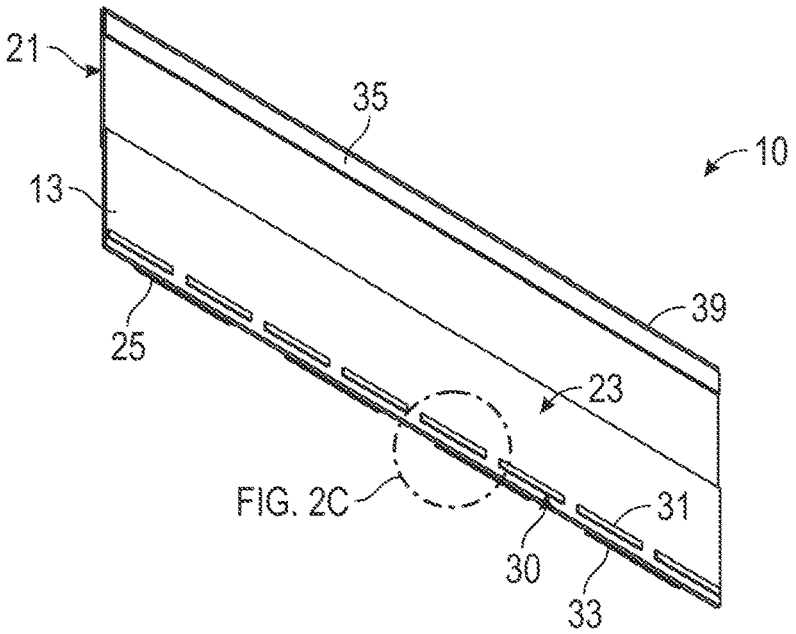
Figure 2C:
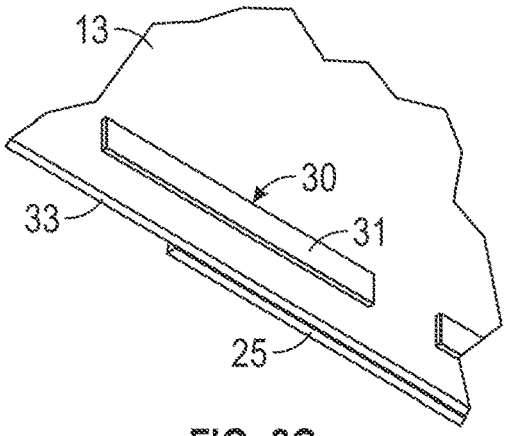

As additionally shown in FIGS. 1B and 2A-2B, the posterior layer 23 can be rectangular and can be in an overlapping relationship with the anterior layer 21. For example, as indicated in FIG. 2B, the posterior layer 23 can be overlapped with the anterior layer 21 so that the strips or lines of adhesive 29 bond the anterior layer 21 and the posterior layer 23 together. The anterior layer 21 and the posterior layer 23 also could be otherwise secured together without departing from the disclosure. The anterior layer 21 and/or the posterior layer 23 further can be otherwise configured, positioned, arranged, and/or shaped without departing from the disclosure. For example, the tabs 25 and openings 27 of the anterior layer 21 could be omitted so that the anterior layer 21 is substantially rectangular. In another example, the posterior layer 23 could include tabs and openings (not shown) that are offset from the tabs 25 and openings 27 of the anterior layer 21 (e.g., so that the tabs of the posterior layer 23 are aligned with the openings 27 of the anterior layer 21). Alternatively, the roofing shingle 10 could have one layer or any suitable number of layers.

As further shown in FIGS. 1B and 2A-2C, a sealant material 31 (e.g., a self-seal sealant material) can be applied in a desired pattern, forming a strip of sealant material 30 or a self-seal strip to the lower surface 13 of the roofing shingle 10 (e.g., along a portion of the rear surface of posterior layer 23 (FIGS. 2A-2B in the illustrated embodiment). In one embodiment, the sealant material 31 can be configured for securing (e.g., adhering) the exposure portion 17 of the roofing shingle 10 to the headlap portion 15 of a previously-installed roofing shingle 10. In the illustrated embodiment, the sealant material 31 can be applied in discrete strips, dots, and/or other pattern features applied in a line along the lower surface of the roofing shingle to form a strip of sealant material 30. Alternatively, the sealant material 31 could be applied in a continuous strip 33 along the roofing shingle.

As illustrated in FIGS. 1B-2B, in embodiments, the sealant material strip 30 can be positioned near a lower edge 33 of the roofing shingle 10. The sealant materials further can be formed with a thickness or width of 0.020" to 0.050", 0.020" to 0.045", 0.020" to 0.040", 0.020 to 0.035", 0.020" to 0.030", 0.020" to 0.025", 0.025" to 0.030", 0.025" to 0.035", 0.025" to 0.040", 0.025" to 0.045", 0.025" to 0.050", 0.030" to 0.035", 0.030" to 0.040", 0.030" to 0.045", or 0.030" to 0.050". Other thicknesses or widths of the sealant material also can be used.

As also shown in FIGS. 1B-2B, a release tape or strip 35 (e.g., a strip of release material) can be applied to the lower surface 13 of the roofing shingle 10. In embodiments, the release strip 35 can be formed of a material that does not form a bond with the sealant material 31 of the strip of sealant material 30. In one non-limiting embodiment, the release strip 35 can include a biaxially oriented silicone coated polyester release film, such as may be used in the manufacture of asphalt roofing shingles, and having a thickness of approximately 48 gauge (0.00048 inch) or greater.

In addition, in some embodiments, a pressure relief channel 37 (FIGS. 4A-4C) is defined in the lower surface 13 of the roofing shingle 10. The pressure relief channel 37 will be formed in a machine direction along a length L (FIGS. 1A-1B) of each roofing shingle. The pressure relief channel can be formed as a depression in the lower surface 13 of the roofing shingle 10. In other embodiments, an additional layer (FIGS. 4A-4B and 5), which can include a coating layer 38, can be applied the roofing shingle. The pressure relief channel 37 can be formed in the coating layer 38 (e.g., a lowermost coating layer extending along the lower surface 13 of the roofing shingle 10) such as by embossing, indenting, scraping or otherwise removing a portion of the coating layer to form a channel in the coating material extending along the length thereof.

In some embodiments, the coating layer can have a thickness, and the pressure relief channel 37 can have a depth in the coating layer that is less than the thickness of the coating layer. Alternatively, the pressure relief channel 37 could extend into multiple coating layers of the roofing shingle 10. By way of non-limiting example, in some embodiments, the pressure relief channel can be formed depression having a depth that can be varied depending on the thickness of the coating layer and/or the thickness of the sealant material.

Figure 4B:
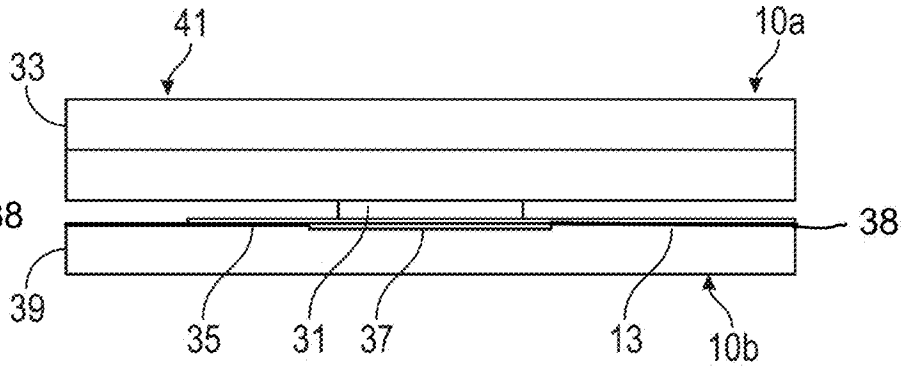
FIGS. 4A, 4B and 4C are schematic detail views of the stacked roofing shingles of FIG. 3.
Figure 4A:
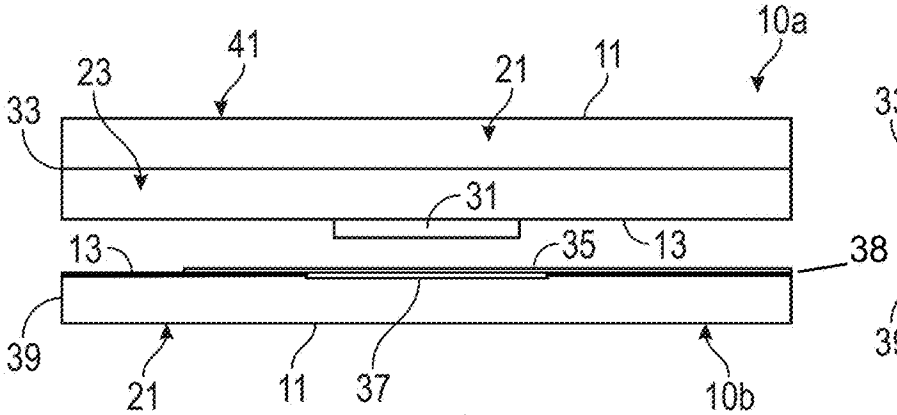
Figure 4C:
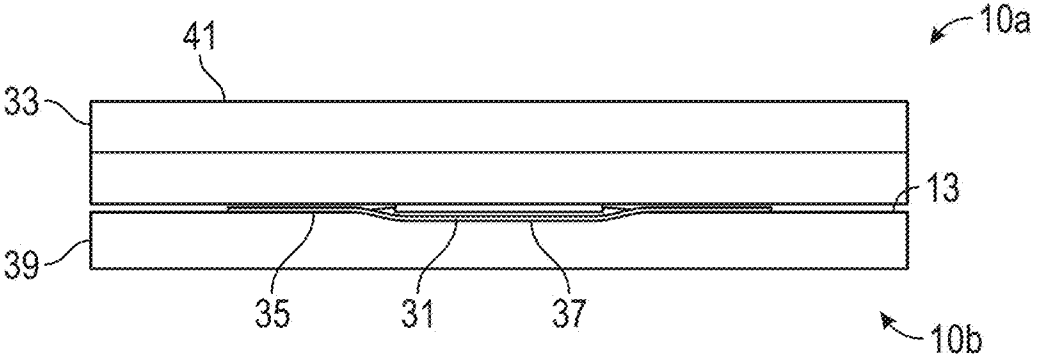

In embodiments, the pressure relief channel will have a depth that is less than or substantially equal to the thickness of the sealant material of the strip of sealant material such that the strip of sealant material can be seated within the pressure relief channel without a substantial reduction in the thickness of the sealant material when a plurality of the roofing shingles are stacked together as shown in FIGS. 4B-4C. In embodiments, as indicated in FIG. 4C, the release strip 35 will be positioned over and will substantially follow the surface of the pressure relief channel such that the sealant material is received within the pressure relief channel on top of the release strip; and in such embodiments, the depth of the pressure relief channel can be at least equal to or greater than a thickness of the sealant material 31 of the strip of sealant material 30.

In an exemplary embodiment, the pressure relief channel 37 can have a depth of approximately 0.001 inch to approximately 0.075 inch. In other embodiments, the pressure relief channel can have a depth of 0.001 to 0.050 inch; 0.001 inch to 0.025 inch; 0.001 inch to 0.020 inch; 0.001 inch to 0.010 inch; 0.001 inch to 0.009 inch; 0.001 inch to 0.008 inch; 0.001 inch to 0.007 inch; 0.001 inch to 0.006 inch; 0.001 inch to 0.005 inch; 0.001 inch to 0.004 inch; 0.001 into to 0.003 inch; 0.001 inch to 0.002 inch; 0.002 inch to 0.075 inch; 0.002 inch to 0.050 inch; 0.002 inch to 0.0025 inch; 0.002 inch to 0.020 inch; 0.002 inch to 0.010 inch; 0.002 inch to 0.009 inch; 0.002 inch to 0.008 inch; 0.002 inch to 0.007 inch; 0.002 inch to 0.006 inch; 0.002 inch to 0.005 inch; 0.002 inch to 0.004 inch; 0.002 inch to 0.003 inch; 0.003 inch to 0.075 inch; 0.003 inch to 0.050 inch; 0.003 inch to 0.025 inch; 0.003 inch to 0.020 inch; 0.003 inch to 0.010 inch; 0.003 inch to 0.009 inch; 0.003 inch to 0.008 inch; 0.003 inch to 0.007 inch; 0.003 inch to 0.006 inch; 0.003 inch to 0.005 inch; 0.003 inch to 0.004 inch; 0.004 inch to 0.075 inch 0.004 inch to 0.050 inch; 0.004 inch to 0.025 inch; 0.004 inch to 0.020 inch; 0.004 inch to 0.010 inch; 0.004 inch to 0.009 inch; 0.004 inch to 0.008 inch; 0.004 inch to 0.007 inch; 0.004 inch to 0.006 inch; 0.004 inch to 0.005 inch; 0.005 inch to 0.075 inch; 0.005 inch to 0.050 inch; 0.005 inch to 0.025 inch; 0.005 inch to 0.020 inch; 0.005 inch to 0.010 inch; 0.005 inch to 0.009 inch; 0.005 inch to 0.008 inch; 0.005 inch to 0.007 inch; 0.005 inch to 0.006 inch; 0.006 inch to 0.075 inch; 0.006 inch to 0.050 inch; 0.006 inch to 0.025 inch; 0.006 inch to 0.020 inch; 0.006 inch to 0.010 inch; 0.006 inch to 0.009 inch; 0.006 inch to 0.008 inch; 0.006 inch to 0.007 inch; 0.007 inch to 0.075 inch; 0.007 inch to 0.050 inch; 0.007 inch to 0.025 inch; 0.007 inch to 0.020 inch; 0.007 inch to 0.010 inch; 0.007 inch to 0.009 inch; 0.007 inch to 0.008 inch;

0.008 inch to 0.075 inch; 0.008 inch to 0.050 inch; 0.008 inch to 0.025 inch; 0.008 inch to 0.020 inch; 0.008 inch to 0.010 inch; 0.008 inch to 0.009 inch; 0.009 inch to 0.075 inch; 0.009 inch to 0.050 inch; 0.009 inch to 0.025 inch; 0.009 inch to 0.020 inch; 0.009 inch to 0.010 inch; 0.010 inch to 0.075 inch; 0.010 inch to 0.050 inch; 0.010 inch to 0.025 inch; 0.010 inch to 0.020 inch; 0.020 inch to 0.075 inch; 0.020 inch to 0.050 inch; 0.020 inch to 0.025 inch; 0.025 inch to 0.075 inch; 0.025 inch to 0.050 inch; or 0.050 inch to 0.075 inch. Other depths also can be used.

In embodiments, the pressure relief channel 37 can have a width that can vary based upon a width of the release strip 35. In embodiments, the pressure relief channel can have a width of ¼ inch to 1 inch, ¼ inch to ⅞ inch; ¼ inch to ½ inch; ¼ inch to ⅜ inch; ⅜ inch to 1 inch, ⅜ inch to ⅞ inch; ⅜ inch to ½ inch; ½ inch to 1 inch; or ½ inch to ⅞ inch, which can be used with for a release strip with a width of approximately 1½ inch or less. Other widths also can be used. For example, if a wider release strip if used, the pressure relief channel can likewise have a greater width. Still further, in some embodiments, multiple, e.g., 2, strips of sealant material can be applied, with the strips of sealant material extending parallel to and in close proximity to each other. In such embodiments, multiple pressure relief channels, including a pressure relief channel for each strip of sealant material can be used, or a single pressure relief channel having an expanded width sufficient to cover multiple strips of sealant materials can be used.

As illustrated in FIGS. 4A-4C, the pressure relief channel 37 will have a width greater than the width of the strip of sealant material, with the sides of the pressure relief channel will extending past the sides of the strip of sealant material such that, to the extent the strip of sealant material is subjected to compression upon stacking of the roofing shingles, the strip of sealant material can flow outwardly toward the sides of the pressure relief channel while remaining substantially contained within the pressure relief channel. In embodiments, the pressure relief channel will have a width of at least the width of the strip of sealant material plus an additional overlap amount designed to account for compression and movement of the sealant material and sheet walk. For example, the strip of sealant material can have a width of ⅛ inch to 1 inch, ⅛ inch to ⅞ inch, ⅛ inch to ¾ inch, ⅛ inch to ½ inch, ⅛ inch to ⅜ inch, ⅛ inch to ¼ inch, ¼ inch to 1 inch, ¼ inch to ⅞ inch, ¼ inch to ¾ inch, ¼ inch to ½ inch, ¼ inch to ⅜ inch, ⅜ inch to 1 inch, ⅜ inch to ⅞ inch, ⅜ inch to ¾ inch, ⅜ inch to ½ inch, ½ inch to 1 inch, ½ inch to ⅞ inch, ½ inch to ¾ inch, ¾ inch to 1 inch, or ¾ inch to ⅞ inch; and the pressure relief channel will have a width that exceeds the width of the strip of sealant material by ¼ inch to 1 inch, ¼ inch to ⅞ inch, ¼ inch to ½ inch, ¼ inch to ⅜ inch, ⅜ inch to 1 inch, ⅜ inch to ⅞ inch, ⅜ inch to ½ inch, ½ inch to 1 inch, ½ inch to ⅞ inch, or ⅞ inch to 1 inch on each side of the strip of sealant material.

The pressure relief channel 37 is shown in dashed lines in FIG. 1B with the release strip 35 applied over and covering the pressure relief channel 37 on the lower side 13 of the roofing shingle 10. As shown in FIGS. 1B and 2, the release strip 35 and the pressure relief channel 37 can be positioned near a headlap edge 39 of the roofing shingle 10.

Figure 3:
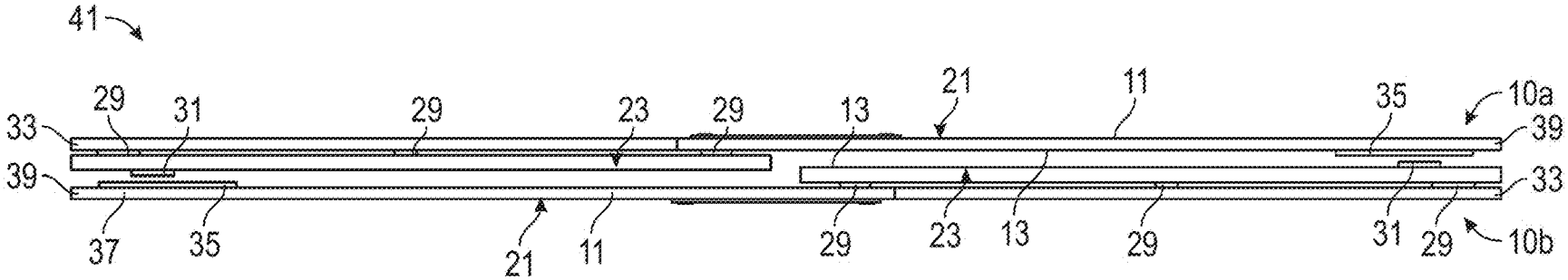
FIG. 3 is a schematic elevation view of stacked roofing shingles according to the exemplary embodiment of the disclosure.

As schematically shown in FIG. 3, a pair of roofing shingles, e.g., a first roofing shingle 10*a* and a second adjacent roofing shingle 10*b* can be arranged in a stack 41 of roofing shingles. In one embodiment, the stack 41 can include multiple stacked pairs of roofing shingles 10*a*, 10*b*, even though only one pair is shown in FIG. 3 for purposes of illustration and without limitation. In the illustrated embodiment, the roofing shingles 10*a*, 10*b* can be arranged with their lower surfaces 13 facing one another and one of the roofing shingles can be rotated or oriented so that the lower edge 33 and the headlap edge 39 of the roofing shingle 10*a* are aligned with the respective headlap edge 39 and lower edge 33 of the roofing shingle 10*b*. Accordingly, the sealant material 31 and the release strip 35 of the roofing shingle 10*a* are aligned with the opposing release strip 35 and sealant material 31 of the roofing shingle 10*b* in the stack 41.

Figure 5:
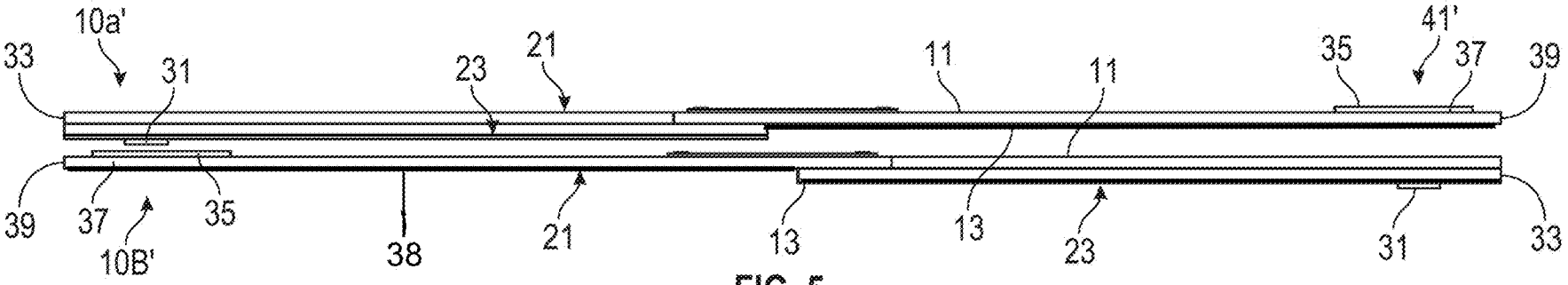
FIG. 5 is a schematic elevation view of an alternative stacked roofing shingles according to the exemplary embodiment of the disclosure.
Figure 6A:
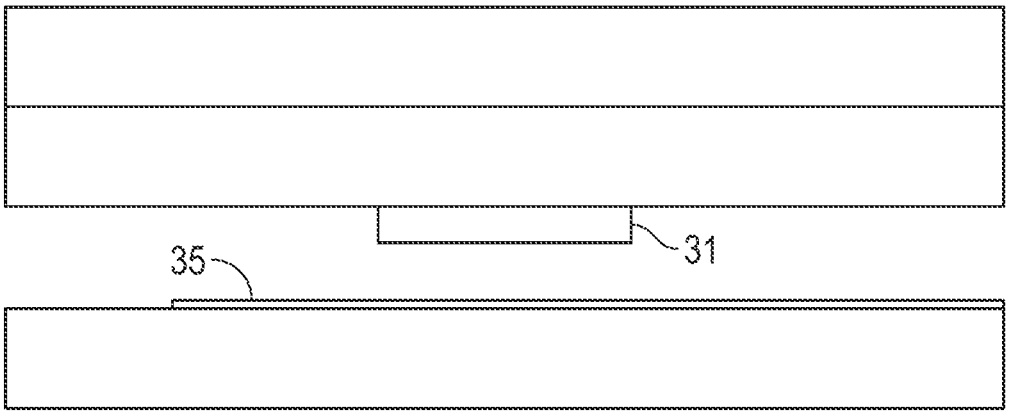
FIGS. 6A and 6B are schematic elevation views of a portion of a stack of roofing shingles wherein the pressure relief channel is omitted.
Figure 6B:
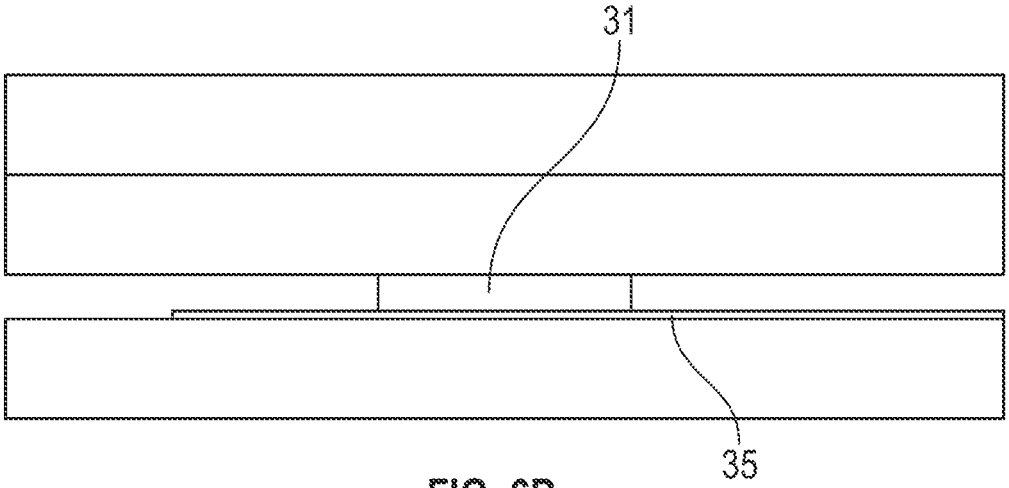

The release strips 35 can help reduce adherence of the sealant material 31 in each roofing shingle 10 in a stack 41 to an adjacent roofing shingle 10. As shown in FIGS. 4B-4C, the release strips will have a width sufficient to overlap the side edges of the pressure relief channel, and as further indicated in FIG. 4C, will substantially follow the contour of the surface of pressure relief channel. In an exemplary embodiment, the release strips 35 can be spaced from the headlap edges 39 by 0.25 inch to 0.35 inch and can be 1 inch to 1.25 inch wide. In embodiments, the center of the sealant material 31 will be spaced from the lower edges 33 of the shingles, while the release strip 35 and the sealant material 31 of one roofing shingle 10 are aligned with the opposed respective sealant material 31 and release strip 35 of the adjacent roofing shingle 10 when stacked as described above. Various other spacing's, configurations, and/or arrangements also can be used, such as indicated in FIG. 5.

In embodiments, the pressure relief channel also can be used for strip shingles, where the release strip and the strip of sealant material are located at the center of the shingle. An example of such shingles can include Royal Sovereign® shingles from GAF of Parsippany, NJ., which shingles have a strip of sealant material on the face of the shingle and the release strip on the back of the shingle. The release strips can have widths that typically range from 1" to 4" if multiple strips of sealant materials are applied to a shingle (e.g., such as in Grand Sequoia® shingles from GAF of Parsippany, NJ.), but can be of greater widths to provide a buffer range on each side of the strips of sealant material. In embodiments, the release strip will have of an overlap on each side of the pressure relief channel of at least ⅛ inch to 1 inch, ⅛ inch to ¾ inch, ⅛ inch to ½ inch, ⅛ inch to ¼ inch, ¼ inch to 1 inch, ¼ inch to ¾ inch, ¼ inch to ½ inch, ½ inch to 1 inch, ½ inch to ¾ inch, or ¾ inch to 1 inch, to ensure good bonding of the release strip is maintained.

As schematically shown in FIGS. 4A and 4B, the pressure relief channel 37 of the roofing shingle 10*b* can be aligned with the sealant material 31 with the release strip 35 extending between the pressure relief channel 37 and the sealant material 31. As indicated in FIG. 4C., during application of the release strip 35 to each of the roofing shingles, the release strip 35 is applied over the pressure relief channel so that it can at least partially conform to the shape of the pressure relief channel 37. For example, as the release strip is applied over the surface of the pressure relief channel, it can be urged downwardly so as to extend in a substantially concave shape that follows the contour of the surface of the pressure relief channel, defining a liner between the sealant material and the surface of the pressure relief channel. In embodiments, the pressure relief channel 37 can help reduce the pressure applied to the sealant material 31 due to the weight of the roofing shingles 10 in a stack 41 or 41' (FIG. 5) during packaging and storage, and thus can help reduce compression and loss of thickness of the sealant material.

By way of illustration and as a non-limiting example, in one embodiment, the pressure relief channel 37 can have a depth that substantially matches the thickness of the sealant material and will be lined with a release strip 35 that can have a thickness of 0.005-0.006 inch or less, which can reduce compression of a sealant material 31 that applied in a thickness of 0.030 inch by 0.005 inch or less, i.e. compressed to less than approximately 0.025 inch, and is received within the pressure relief channel upon stacking of a plurality of roofing shingles. In contrast, the same sealant material 31 applied in a thickness of 0.030 inch could be substantially compressed to 0.020 inch or less if the pressure relief channel 37 is omitted (e.g., FIGS. 6A and 6B).

Since a reduction in the thickness of the sealant material 31 can reduce the ability of the sealant to form a contact bond with an adjacent roofing shingle upon installation, roofing shingles without the pressure relief channel 37 may require additional sealant material applied thereto in order to compensate for the reduced performance due to compression of the sealant material during packaging and storage. The pressure relief channel 37 in the roofing shingles 10, thus can reduce the compression on the sealant material 31 so that less sealant material is needed to compensate for the reduction in the thickness of the sealant material. In some embodiments, this can result in reduced usage of sealant material applied during manufacturing of the roofing shingles and reduced manufacturing costs. The sealant material 31, the release strip 35, and/or the pressure relief channel 37 also could be otherwise configured, positioned, arranged, and/or shaped without departing from the disclosure.

In an alternative embodiment, the roofing shingles 10*a*' 10*b*' (FIG. 5) can be arranged in a stack 41 wherein the roofing shingles are positioned with their upper surfaces 11 facing upwardly (e.g., so that the upper surface of the roofing shingle 10*b*' faces the lower surface of the roofing shingle 10*a*'). The release strips 35 and the pressure relief channels 37 alternatively could be positioned on the upper surfaces 11 of the roofing shingles 10*a*', 10*b*' so that the release strip 35 and the pressure relief channel 37 of the roofing shingle 10*b*' engages the sealant material 31 on the lower surface 13 of the roofing shingle 10*a*'.

In another embodiment, the anterior layers 21 and the posterior layers 23 of multiple roofing shingles 10 can be formed so as to define a shingle body or web of a roofing shingle material. For example, the web can include one or more anterior portions 21 and one or more posterior portions 23, with the tabs 25 of each pair of anterior portions 21 being intermeshed. In an exemplary embodiment, the web can be formed by moving a substrate of roofing shingle material along a processing path or path of travel as layers of material are added to the substrate to form the anterior layers 21 and the posterior layers 23 of the web.

In still another embodiment, the pressure relief channel 37 can be formed in one or more layers of roofing shingle material applied along the lower surface of the substrate as the layers of roofing shingle material are added to the substrate or shortly after the layers are added. For example, a coating layer can be applied to the lower surface of the substrate by a coater as it is moved along a processing path, after which scrapers or other suitable removal apparatus will engage the lower surface of the substrate so that the scrapers can be scrape off, cut out, wipe off, or otherwise remove a predetermined amount of the coating layer along the lower surface of the substrate as the substrate moves in the machine direction to form the pressure relief channel 37 therein. Subsequently, the release strips 35 can be secured to the substrate over the pressure relief channel 37, and the sealant material 31 applied to the lower surface of the substrate to form the self-seal strip (e.g., as shown in FIGS. 1B, 2A-2B, and 3). Various additional exemplary web configurations also can be used.

In some embodiments, the substrate will further be cut to form individual ones of the roofing shingles 10 (FIGS. 1A, 1B, and 2A-2B). Subsequently, the roofing shingles 10 can be paired and arranged in stacks 41 for packaging, storage, etc. As shown in FIGS. 3-4C, the paired roofing shingles can be in an opposed arrangement oriented so that the sealant material 31 of one roofing shingle can be located in registration with the pressure relief channel 37 and a release strip 35 of another roofing shingle, so that the sealant material 31 is at least partially received within the pressure relief channel 37 when the roofing shingles 10 are arranged in stacks 41, such as for packaging, storage and/or transport. The roofing shingles 10 could be otherwise formed without departing from the disclosure.

Any of the features of the various embodiments of the disclosure can be combined with, replaced by, or otherwise configured with other features of other embodiments of the disclosure without departing from the scope of this disclosure. The configurations and combinations of features described above and shown in the figures are included by way of example.

The present disclosure has been described herein in terms of examples that illustrate principles and aspects of the present disclosure. The skilled artisan will understand, however, that a wide gamut of additions, deletions, and modifications, both subtle and gross, may be made to the presented examples without departing from the spirit and scope of the present disclosure.

The invention claimed is:

1. A roofing shingle comprising:

a plurality of layers of shingle material, the plurality of layers comprising:

at least one layer forming an exterior surface of the roofing shingle and including an upper surface having a headlap portion, the headlap portion configured to be overlapped by at least one additional roofing shingle arranged in a next higher course of roofing shingles on a roof; the headlap portion comprising a substrate coated with asphalt;

at least one additional layer attached to the at least one layer and including a lower surface opposite the upper surface;

a pressure relief channel formed in the asphalt of the upper surface and extending along a portion of the headlap portion of the roofing shingle;

a release strip positioned over the pressure relief channel; and a strip of sealant material applied to the lower surface;

wherein the strip of sealant material is positioned along a lower edge of the roofing shingle, and the pressure relief channel is formed along an upper edge of the roofing shingle such that the strip of sealant material applied to the lower surface is not aligned with the pressure relief channel formed in the upper surface;

wherein a portion of the lower surface of the at least one additional layer directly opposite the pressure relief channel is substantially planar with a remainder of the lower surface;

wherein the roofing shingle is configured to be stacked in a stack of roofing shingles with the upper surface of the roofing shingle facing upwardly and with the lower surface of the roofing shingle facing downwardly such that when the roofing shingle is aligned with a second roofing shingle in the stack of roofing shingles, a lower surface of the second roofing shingle is positioned on top of the upper surface of the roofing shingle and the pressure relief channel formed in the asphalt of the upper surface of the roofing shingle is aligned with the strip of sealant material applied to the lower surface of the second roofing shingle;

wherein the pressure relief channel of the roofing shingle is configured to at least partially receive the strip of sealant material of the second roofing shingle therein.

2. The roofing shingle of claim 1, wherein the upper surface further includes an exposure portion adjacent the headlap portion; and wherein the strip of sealant material is applied to the lower surface of the at least one additional layer opposite the exposure portion.

3. The roofing shingle of claim 1, wherein the pressure relief channel comprises a depression formed in the upper surface and having a depth of 0.001 inch to 0.075 inch.

4. The roofing shingle of claim 1, wherein the release strip is configured to extend along and at least partially conform to a surface of the pressure relief channel when the roofing shingle and the second roofing shingle are stacked with the strip of sealant material of the second roofing shingle at least partially received within the pressure relief channel of the roofing shingle.

5. The roofing shingle of claim 4, wherein the strip of sealant material comprises a width of ⅛ inch to 1 inch; wherein the pressure relief channel comprises sides, a width that extends between opposite sides and exceeds the width of the strip of sealant material by ¼ inch to 1 inch, and a depth equal to or less than a thickness of the strip of sealant material; and wherein the release strip overlaps each side of the pressure relief channel by 1 inch or less.

6. The roofing shingle of claim 1, wherein when the roofing shingle and the second roofing shingle are arranged in the stack of roofing shingles, the release strip is received within an at least partially conforms to a surface of the pressure relief channel, and the sealant material remains substantially contained within the pressure relief channel.

7. A stack of roofing shingles, comprising:

a plurality of roofing shingles, each of the roofing shingles comprising:

an upper surface coated with asphalt and including a headlap portion, the headlap portion configured to be overlapped by at least one additional roofing shingle arranged in a next higher course of roofing shingles on a roof;

a lower surface opposite the upper surface;

a pressure relief channel formed in the asphalt of the upper surface of the roofing shingle and extending along a portion thereof;

a release strip positioned along the upper surface of the roofing shingle and covering the pressure relief channel;

a strip of sealant material disposed along at least a portion of the lower surface of the roofing shingle;

wherein the strip of sealant material is positioned along a lower edge of the roofing shingle, and the pressure relief channel is formed along an upper edge of the roofing shingle such that the strip of sealant material applied to the lower surface is not aligned with the pressure relief channel formed in the upper surface;

wherein the plurality of roofing shingles are configured to be stacked in a stack of roofing shingles with the upper surface of each roofing shingle facing upwardly and with the lower surface of each roofing shingle facing downwardly and with a strip of sealant material positioned along a lower surface of a first roofing shingle of the stack of roofing shingles aligned with a pressure relief channel formed in an upper surface of a second roofing shingle;

wherein as the roofing shingles are stacked, the strip of sealant material of the first roofing shingle and the release strip of the second roofing shingle are at least partially received within the pressure relief channel of the second roofing shingle such that the release strip extends along and at least partially conforms to a surface of the pressure relief channel and forms a liner between the strip of sealant material of the first roofing shingle and the pressure relief channel of the second roofing shingle.

8. The stack of roofing shingles of claim 7, wherein when the first and second roofing shingles are stacked, the strip of sealant material of the first roofing shingle remains substantially contained within the pressure relief channel of the second roofing shingle.

9. The stack of roofing shingles of claim 7, wherein the strip of sealant material comprises a self-seal sealant material.

10. The stack of roofing shingles of claim 7, wherein the strip of sealant material comprises a thickness of 0.020 inch to 0.050 inch and a width of ⅛ inch to 1 inch; wherein the pressure relief channel comprises sides, a depth that is less than or substantially equal to the thickness of the strip of sealant material, and a width that exceeds the width of the strip of sealant material by 1 inch or less.

11. The stack of roofing shingles of claim 7, wherein when the strip of sealant material is at least partially received within the pressure relief channel when the first and second roofing shingles are stacked, a thickness of the strip of sealant material is reduced by 0.005 inches or less.

12. A method comprising:

(a) moving a substrate of roofing shingle material along a path;

wherein the substrate is coated with asphalt;

(b) forming a pressure relief channel in the asphalt of the substrate;

(c) applying a strip of sealant material to the substrate to form a strip of sealant material therealong;

(d) cutting the substrate to form a plurality of roofing shingles, each roofing shingle of the plurality of roofing shingles comprising at least one layer forming an exterior surface of the roofing shingle and including an upper surface having a headlap portion defined therealong, and at least one additional layer of roofing shingle material attached to the at least one layer and including a lower surface opposite the upper surface;

wherein the pressure relief channel is formed along the upper surface of the roofing shingle extending along a portion of the headlap portion of the roofing shingle;

wherein the strip of sealant material is positioned along the lower surface;

wherein the strip of sealant material is positioned along a lower edge of the roofing shingle, and the pressure relief channel is formed along an upper edge of the roofing shingle such that the strip of sealant material is not aligned with the pressure relief channel;

(e) stacking the plurality of roofing shingles;

wherein the roofing shingles are configured to be stacked in a stack of roofing shingles with the upper surface of each roofing shingle facing upwardly and with the lower surface of each roofing shingle facing downwardly;

wherein as the plurality of roofing shingles are stacked, the strip of sealant material applied to a lower surface of a first roofing shingle in a stack of roofing shingles is aligned with a pressure relief channel formed along an upper surface of a second roofing shingle in the stack of roofing shingles such that the strip of sealant material of the first roofing shingle is at least partially received within the pressure relief channel of the second roofing shingle; and wherein a portion of a surface of each roofing shingle directly opposite the pressure relief channel is substantially planar with a remainder of the surface;

(f) applying a release strip over the pressure relief channel of each roofing shingle;

wherein the release strip is configured to extend along and at least partially conform to a surface of the pressure relief channel formed along the upper surface of the second roofing shingle when the first roofing shingle and the second roofing shingle are stacked and the strip of sealant material of the first roofing shingle is at least partially received within the pressure relief channel of the second roofing shingle.

13. The method of claim 12, wherein the strip of sealant material of the second first roofing shingle is at least partially received within the pressure relief channel of the first second roofing shingle when the first roofing shingle and the second roofing shingle are arranged in the stack of roofing shingles without substantial compression of the sealant material of the strip of sealant material of the first roofing shingle and with the sealant material remaining substantially contained within the pressure relief channel of the second roofing shingle.

14. The method of claim 12, wherein a substantially consistent thickness of a portion of the substrate of each roofing shingle along which the pressure relief channel extends is maintained when the first and second roofing shingles are stacked and the strip of sealant material of the first roofing shingle is at least partially received within the pressure relief channel of the second roofing shingle.

15. The method of claim 12, further comprising applying a plurality of granules along the asphalt of the upper surface of the substrate.

16. The roofing shingle of claim 1, further comprising a plurality of granules covering the asphalt of the upper surface of the substrate.

17. The stack of roofing shingles of claim 7, further comprising a plurality of granules covering the asphalt of the upper surface.

18. The stack of roofing shingles of claim 7, wherein the release strip contacts the asphalt of the upper surface of the roofing shingle.

* * * * *